US007111416B2

(12) United States Patent
Gallegos

(10) Patent No.: US 7,111,416 B2
(45) Date of Patent: Sep. 26, 2006

(54) FOOTWEAR

(76) Inventor: Alvaro Z. Gallegos, 6932 4th St. NW., Albuquerque, NM (US) 87107

( * ) Notice: Subject to any disclaimer, the term of this patent is extended or adjusted under 35 U.S.C. 154(b) by 0 days.

(21) Appl. No.: 10/409,751

(22) Filed: Apr. 7, 2003

(65) Prior Publication Data

US 2004/0194351 A1 Oct. 7, 2004

(51) Int. Cl.
*A43B 3/24* (2006.01)
*A43C 13/00* (2006.01)

(52) U.S. Cl. ..... 36/100; 36/15

(58) Field of Classification Search ..... 36/15, 36/100, 101
See application file for complete search history.

(56) References Cited

U.S. PATENT DOCUMENTS

| | | | | |
|---|---|---|---|---|
| 3,538,628 | A | 11/1970 | Einstein | |
| 4,279,083 | A | 7/1981 | Dilg | |
| 4,377,042 | A | 3/1983 | Bauer | |
| 4,463,505 | A | 8/1984 | Duclos | |
| 5,317,822 | A | 6/1994 | Johnson | |
| 5,339,543 | A * | 8/1994 | Lin | 36/101 |
| 5,353,522 | A | 10/1994 | Wagner | |
| 5,410,821 | A | 5/1995 | Hilgendorf | |
| 5,615,497 | A | 4/1997 | Meschan | |
| 5,727,334 | A | 3/1998 | Cougar | |
| 5,782,014 | A | 7/1998 | Peterson | |
| 5,836,090 | A * | 11/1998 | Smith | 36/7.6 |
| 5,996,252 | A | 12/1999 | Cougar | |
| 6,345,454 | B1 | 2/2002 | Cotton | |
| 6,389,712 | B1 * | 5/2002 | Schelling | 36/15 |
| 2003/0200675 | A1 * | 10/2003 | Gross | 36/15 |
| 2003/0230007 | A1 * | 12/2003 | Walton | 36/15 |

OTHER PUBLICATIONS

U.S. Appl. No. 09/791,576, filed Jul. 2001, Brown.

* cited by examiner

*Primary Examiner*—Ted Kavanaugh
(74) *Attorney, Agent, or Firm*—Kenneth L. Nash

(57) ABSTRACT

The present invention relates to footwear which has improved shock absorbency due to a cushioning and has superior support due to a rigid or semi-rigid orthotic plate. The orthotic plate may be removably or securably attachable to the upper, and the padding may be removably or securably attachable to the orthotic plate. The cushioning may further may have supporting blades incorporated therein to counteract any undesired deforming characteristics of the cushioning and/or a bottom plate may be securably or removably attachable to the bottom side of the cushioning. The bottom plate may also have gripping elements which are permanently or removably attachable to the plate to compensate for wear, or for a change in activities. Further, the upper may be removably and attachable and interchanged with other types of removably attachable uppers.

32 Claims, 5 Drawing Sheets

FOOTWEAR

TECHNICAL FIELD

The present invention relates to footwear which has improved shock absorbency, comfort, and versatility.

PRIOR ART

The following patents are believed to be prior art of the current invention: U.S. Pat. Nos. 4,377,042; 5,317,822; 5,353,522; 5,410,821; 5,615,497; 5,996,252 and 5,727,334; and 6,345,454.

DETAILED DESCRIPTION OF THE PREFERRED EMBODIMENT

For purposes of the description of this invention, the terms "upper," "lower," "right," "left," "vertical," "horizontal," "top," "bottom," and other related terms shall be defined in relation to embodiments of the present invention as it is shown and illustrated in the accompanying figures. However, it is to be understood that the invention may assume various alternative structures and processes and still be within the scope and meaning of this disclosure. Further, it is to be understood that any specific dimensions and/or physical characteristics related to the embodiments disclosed herein are capable of modification and alteration while still remaining within the scope of the present invention and are, therefore, not intended to be limiting.

One way to increase the comfort and also shock absorbency of footwear is to increase the amount of shock absorbing material and/or by using padding comprised of various materials, especially foam. This is notably advantageous in athletic footwear worn by runners or other athletes who are involved in rigorous sporting activities since the wearer's footwear and body encounters substantial forces especially from the hard surfaces which are contacted by the wearer's footwear. And, even in the footwear of this invention worn by non-athletes, padding makes the footwear more comfortable.

In conjunction with the superior shock absorbing advantages of the padding, the padding may be removably attached and interchanged with padding types and/or varying thicknesses that are used for special purposes such as marathons or long distance runs. Also, when the padding shows wear or loses some of the shock absorbing capabilities or has changed compressibility, the worn padding can be replaced with new padding. By also making parts or components of the footwear replaceable, the durability of the footwear may also be enhanced.

Figure 1:
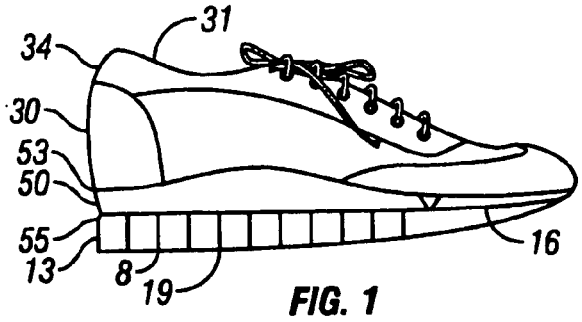
FIG. 1 is a side view of an embodiment of the footwear.
Figure 7:
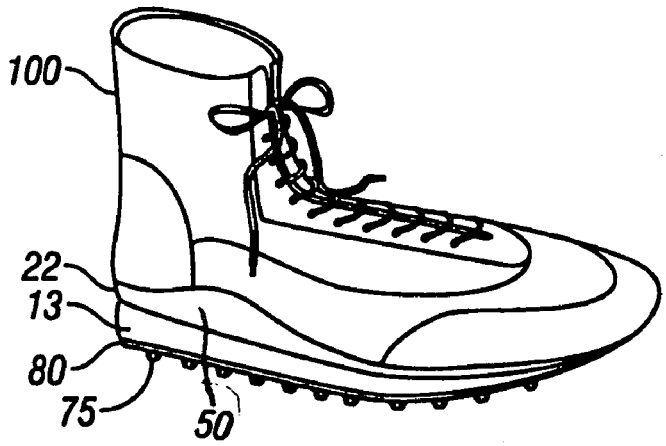
FIG. 7 is a view of an embodiment of high-top footwear with a plate and gripping members.
Figure 8:
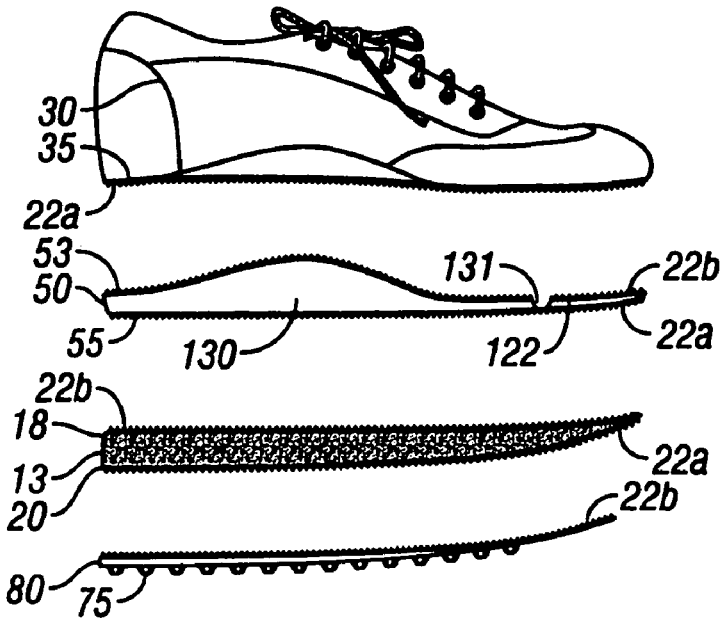
FIG. 8 is an expanded view of an embodiment of footwear.

Several variations of footwear of this invention are illustrated in FIGS. 1–15. FIG. 1 shows one variation of the footwear with an upper 30 having an inside 31 and an outside 34. The footwear also has an orthotic plate 50 that has a first surface 53 and a second surface 55 and a layer of padding 13, having a top side 16 and a bottom side 8 that in an embodiment also serves as the wear surface. Also, in an embodiment, there are stabilizing blades 19 within the padding. The style of the upper 30 and the manner of securing it to orthotic plate 50 will vary depending on the design of the footwear. The upper 30 includes all types of footwear, and the invention is especially advantageous in closed footwear such as in athletic shoes, work boots, hiking boots, etc. The upper 30 may be construction of any type of material such as canvas, leather, synthetic leather, vinyl, plastic, etc., or a combination thereof, and any other materials known to or used by one of ordinary skill in the art. The upper 30 can be secured to the orthotic plate using conventional techniques such as gluing, but it could also be stitched and/or secured by adhesive. Alternatively, the upper 30 may be removably attached to the orthotic plate such as by a stud and aperture connection, Velcro®, i.e., mated hooks and loops, as shown in FIG. 8. As an alternative, other means of attachment such as fasteners, adhesives, magnets, a wedge and aperture connection, a screw, a bolt, a hinge, a staple, a nut, studs, snaps, wedges and a combination thereof may be used, to allow replacement or interchanging of the orthotic plate. An insole 145 which may be made of textile material such as cotton, felt, linen, polyester, or leather, silicon, or other such materials that one of the ordinary skill of the art uses as insoles may also be placed inside the footwear as in, e.g., FIG. 5.

Figure 3:
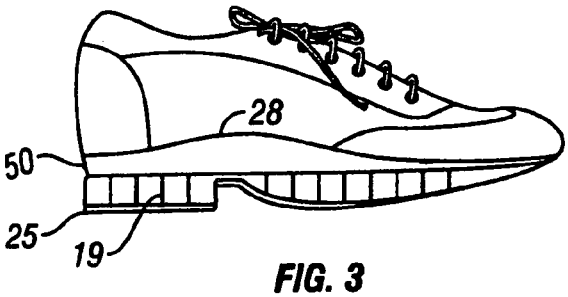
FIG. 3 is a side view of an embodiment of the footwear.
Figure 4:
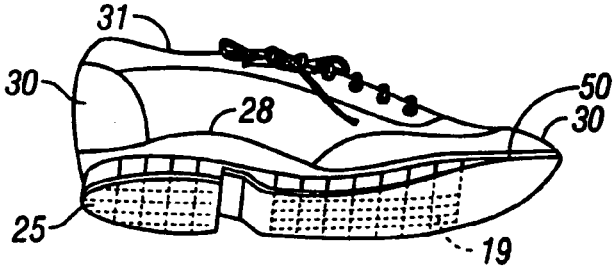
FIG. 4 is a perspective view of an embodiment of the footwear.
Figure 5:
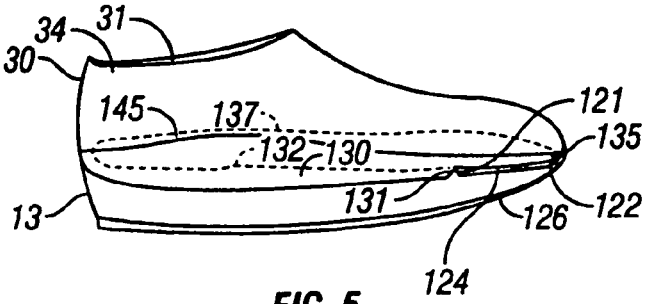
FIG. 5 is a side view of a footwear embodiment showing a multipiece orthotic plate.
Figure 6:
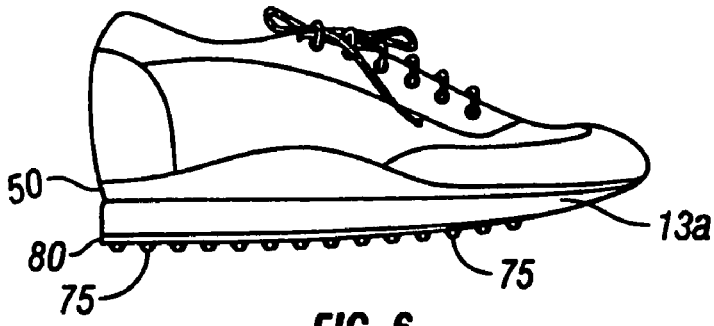
FIG. 6 is a side view of a footwear embodiment with a plate and gripping members.

The orthotic plates of the footwear provide superior support, and typically have a raised arch area 28, see e.g., FIGS. 3–4, and may also have a flexible or a semi-flexible front portion. Further, the orthotic plate has a first surface 124 and second surface 126. The orthotic plate may be a unitary piece or may be formed of more than one piece, with for example, a first piece 122 that typically extends to or beyond the front toe area 135, and a second piece 130 that extends to the rear most portion of the footwear, and the second piece 130 which is preferably rigid or nearly rigid forms a hinge-like area 131 adjacent to the end 121 of the first piece 122 that is preferably semi-flexible or flexible. E.g., FIG. 5. The orthotic plate typically extends from a metatarsal area 137 of a wearer's foot, to the rearmost portion of the footwear generally proximate to the heel area. In other embodiments, a bottom plate 80 may also be incorporated below the padding, forming a two-plate system. See FIGS. 6–8, and 12–14.

The footwear of this invention has cushioning 13 or padding below the orthotic plate 50. There may also be an undersole or outsole 25, see FIGS. 3–4, beneath the cushioning or padding 13, but the padding may also serve as the wear surface 8. See FIGS. 1–2. The undersole or outsole 25 may be fixedly or removably attached to the padding by the various ways known to one skilled in the art. The padding 13 can be removable, changeable, and replaceable and is preferably provided in a shape substantially similar and/or identical to the shape of the orthotic plate, such that it will cover the lower surface of the entire orthotic plate. In other embodiments, the padding can extend at least the length and the width of the footwear, although in some embodiments, the padding may be thinner and/or tapered 13*a* in the toe area of the footwear. See e.g., FIG. 6. The padding may be of a variety of heights and may vary depending upon the wearer's needs and/or uses as well as the type of padding utilized. Preferably, the padding is between about ½ inch to about 3½ inches in height in its uncompressed state, but may be of a lesser or greater height as well. In the embodiments without a bottom plate, e.g., FIGS. 1–4, the padding is preferably about one ½ inch to about 3½ inches in height and in the embodiments with a bottom plate 80, see e.g., FIGS. 6–8, and 12–15 the padding is preferably about ½ inch to about 2 inches in height, but may be of other heights as well.

The padding or cushioning layer 13 may comprise a variety of materials especially foamed materials which have elastic or rebounding properties, such as materials comprised of silicon, neoprene, natural rubber foams, synthetic rubber foams and polyurethane, polyether and polyester foams neoprene, Vinyl Nitrile, Styrene-Butadiene Rubber (SBR), Polyethylene (PE), ethyl vinyl acetate (EVA), ethylene propylene terpolymer (EPT), EPT/PE/Butyl Rubber, Neoprene/EPT/SBR, epichlorohydrin (ECH), and nitrile (NBR) or a combination thereof, or other cushioning materials known or used by one skilled in the art. Alternatively, in the two plate system other means can be used as cushioning such as leaf and coil wound springs, with or without padding. (not shown) The density and cell characteristics of the padding of the foam material are believed to be critical features in terms of providing the appropriate cushioning and rebound characteristics for cushioning and may vary depending upon the type of activity of footwear in question.

Preferably the cushioning or padding, such as foam 14, has a low to medium density so it is deformable. A low density padding comprises material within the range of about 0.08 g/cm$^3$ to about 0.50 g/cm$^3$. An even more preferred range of densities for padding is material between about 0.1 g/cm$^3$ to 0.30 g/cm$^3$.

Figure 12:
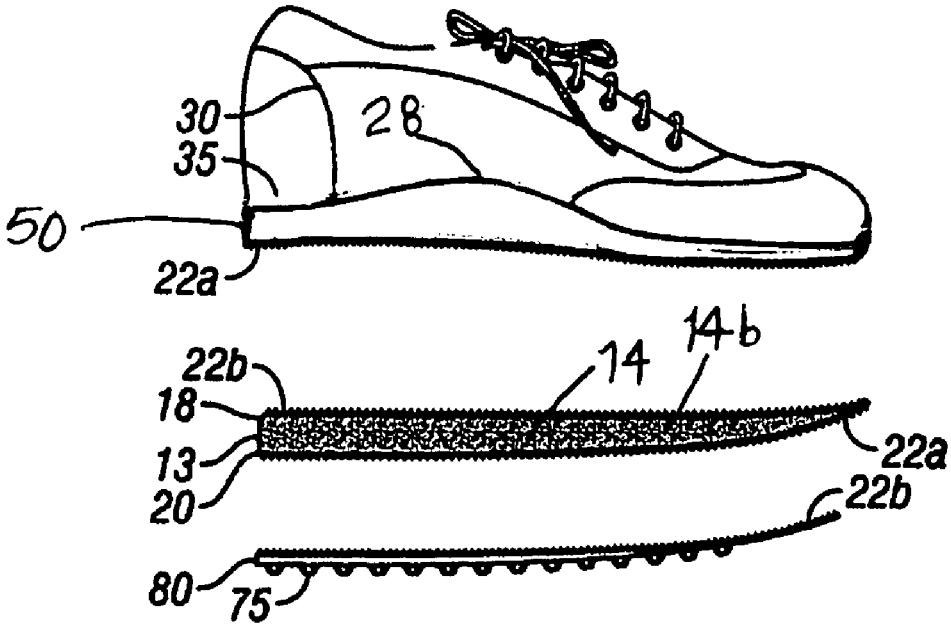
FIG. 12 is an expanded view of an embodiment of the footwear having removable and replaceable components, and closed-cell foam padding.

The padding 13 may be constructed of a closed-cell foam 14*b* material, see. e.g., FIG. 12, having a density in the range of about 0.08 g/cm$^3$ to 0.50 g/cm$^3$, or of other suitable densities known to one skilled in the art. Alternatively, open-cell foam 14*a* material, see. e.g., FIG. 14, having a density in the range of about 0.08 g/cm$^3$ to 0.40 g/cm$^3$ may be used, or of other suitable densities known to one skilled in the art.

Closed-cell foam material, in general, may demonstrate a greater resistance to wear as compared to open-cell foams. Open cell foam is a material where the open-air chambers in the foam are interconnected. This makes for extremely soft and highly compressible foam. While open-cell foam may be very comfortable, it has some disadvantages because of the high compressibility of the foam, especially if it is of a density which is too low or of a material that absorbs water. In contrast, the open air chambers in the closed-cell foam are completely surrounded by foam and not interconnected. As a result, the closed cell foam does not compress easily, yet provides good shock absorbency since the air pockets in the foam are completely encapsulated.

As a further alternative, since open-cell foam is typically more comfortable, i.e., more compressible and since closed-cell foam provides firmer support, a dual or multi-density padding may also be used, alternating layers of closed-cell foam 14*b* and open-cell foam 14*a*, with the closed cell foam giving stability and the open cell foam giving a cushioning effect. See e.g., FIG. 15. Depending upon the materials used and the characteristic desired, the alternating layers may each be of about 0.25 inches to about 1 inch in thickness, but may also be of other thicknesses.

The foam padding may be fabricated by pouring foamed materials into a frame that is heated and processed into sheets that are then cut to size. However, the cost of cutting and shaping foam is high and results in significant material wastage. To avoid wasting materials, the padding is preferably molded for each size and style of footwear. Additionally, a portion of the foam may be compression molded.

In some cases, depending upon the characteristics of the foam materials and the height of foam used, the materials may have undesired deformation. To counteract any undesired deformation and/or to control the characteristics of the low density foam, the padding may further may have supporting or stabilizing blades incorporated therein. See FIGS. 1–4. In these circumstances, the stabilizing blades 19, may be incorporated into the foam and/or a semirigid plate or rigid plate may be positioned below the underside of the cushioning with or without stabilizing blades in the cushioning.

Figure 2:
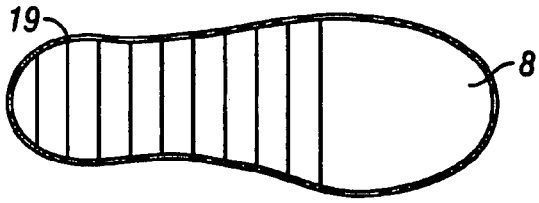
FIG. 2 is a bottom view of an embodiment of the footwear.

The stabilizing blades 19 are made of rigid, semi-rigid flexible, and/or semi-flexible materials such as rubber, plastic or denser foams made from EVA, silicon, neoprene, and the like incorporated into the foam, as well as plastic, rubber, metal, metal alloys, vinyl. There are a multitude of ways the stabilizing blades 19 may be arranged or position within the foam and/or cushioning. For example, FIGS. 1–2 shows footwear wherein the stabilizing blades are parallel to one another. FIGS. 3–4 in contrast, show footwear wherein the stabilizing blades are arranged in a cross hatch or grid fashion. The blades may be placed throughout the foam or may be concentrated in certain areas, or alternatively spaced consistently, or fairly consistently. The blades 19 are preferably about ½ inch to about 1½ inches apart, but may be of other distances. The blades may also be straight, waved, and/or curved. The blades could also be arranged in a variety of other ways by example, but without limitation such as triangles, rectangles, hexagons, octagons (not shown). The blades may also zigzag through the foam, and may alternatively be arranged in a wave like patterns (not shown). There are many ways the stabilizing blades may be incorporated into the foam. They may be incorporated into the foam at the time of the original manufacture of the foam, or heat bonded or glued to already made foam. There are other means which also may be used to stabilize the foam such as a plurality of small springs.

As an alternative or in addition to the stabilizing blades, a rigid or semirigid bottom 80 plate may be placed beneath the foam layer. See FIGS. 6–8, and 12–14. If a bottom plate is used along with the orthotic plate, the footwear of this invention has a two-plate system. The bottom plate may comprise metal, plastic, compressed EVA or other compressed foams, silicon, or neoprene foam. The bottom plate may serve as the wear surface, or may alternatively have an outsole further attached to the outer surface of the plate (not shown). The plate may be glued or heat bonded to the foam, may be removably attached through means such as a plurality of hooks and eyes such as Velcro® or may alternatively have telescoping pins with an enlarged end like that of a nail or screw head that attaches at one end to the orthotic plate and attaches at the other end to the plate. The bottom plate 80 may also have gripping members 75 such as spikes, cleats, studs, and the like permanently or removably attachable to the bottom plate 80.

Figure 13:
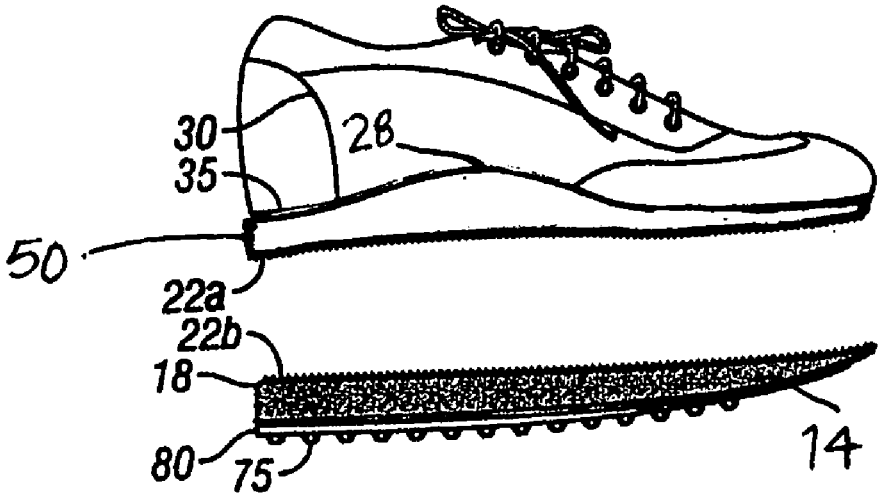
FIG. 13 is an expanded view of an embodiment of the footwear having removable and replaceable components, and foam padding.
Figure 14:
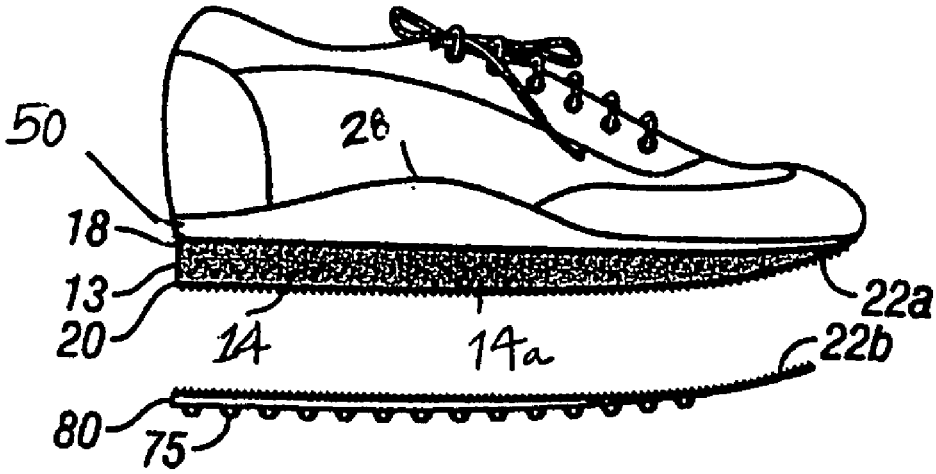
FIG. 14 is an expanded view of an embodiment of the footwear having removable and replaceable components, and open-cell foam padding.
Figure 15:
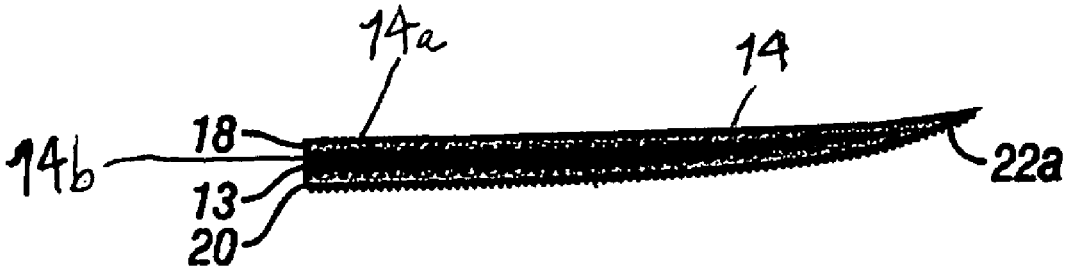
FIG. 15 is an view of padding with layers of open-cell and closed-cell foam.

FIG. 8 shows footwear that is disassembled and shows the first surface 53 of the orthotic plate 50 separated from the bottom surface 35 of the upper 30, the padding 13 separated from the second surface 55 of the orthotic plate 50, and the bottom plate 80 separated from the cushioning 13. FIGS. 13–14 also show footwear that is disassembled, and FIG. 15 shows padding with layers of open-cell foam 14*a* and closed-cell foam 14*b*. In use, these counterparts are mated and fastened by applying pressure to the hooks and loops, or other fastening means which engage each other. The orthotic plate 50, which as shown in FIG. 8 comprises a first piece 122, a second piece 130 and the hinged area in between 131. The foam padding 13 may also be removably attached to the orthotic plate such as by a stud and aperture connection, Velcro®, i.e., mated hooks and loops, fasteners, adhesives, magnets, a wedge and aperture connection, a screw, a bolt, a hinge, a staple, a nut, studs, snaps, wedges and a combination thereof or by other means known to one skilled in the art. If a bottom plate 80 is also used, it may also be removably attachable to the padding by the same foregoing means or means such as Velcro® 22 or other hook-and-loop type fasteners. See e.g., FIGS. 8, 12, and 14. Additionally, the orthotic plate 50, may also be removably attachable to the bottom 35 of the upper 30. Furthermore, the upper may be replaced with another type or style of upper, such as an upper that is a sandal or open toed shoe, a dress upper, a boot, and other types of uppers known to one skilled in the art that have been modified to be removably attachable such as by the means described herein for the orthotic plate and cushioning.

As shown in FIGS. 8 and 15, the top 18 and the bottom 20 of the padding 13 has a layer, strip, or portion 22 of one of the counterpart elements 22*a*, 22*b* of the hook-and-loop type fasteners, such as Velcro®. Above the top of the cushioning, the orthotic plate also has at least one of the counterpart elements 22*b* of the hook-and-loop type fasteners, such as Velcro®, which is compatible with that the counterpart elements 22*a* on the bottom surface 35 of the upper 30. Alternatively, any of the components that are covered with Velcro®, could also have portions of both the hook and loop type elements as long as there are corresponding counterparts on the surface of the adjacent component which is removably attachable. See e.g., FIGS. 12–15. If Velcro® or Velcro®-like material is used, it is preferably attached to the top or bottom of the components such as the orthotic plate, front portion 122, padding 13, or bottom plate 80 by adhesive, glue, or other suitable means, such as stitching and heat bonding. The entire surface of the orthotic plate and cushioning or other such components may be covered by Velcro® or other attaching means or alternatively only portions such as the perimeter of the components may have Velcro® or attachment portions. It is preferred that the hook-and-loop fasteners used in the present invention be selected from the strongest of those available on the market to resist separation while worn. Still, even when using such strong fasteners the wearer can remove worn padding and quickly install replacement padding or components by separating and then pulling the padding from the bottom of the footwear and aligning and pressing the replacement padding in place. The pressure applied by the wearer's weight further anchors and/or secures the padding and other removable attachable components to the footwear. Once all the layers and/or counterparts which are removably attachable, interchangeable, and replaceable are connected together with the upper, they look like and function like conventional footwear.

The bottom plate 80 may also be permanently or removably attached to the padding 13 such as by a stud and aperture connection, Velcro®, i.e., mated hooks and loops, fasteners, adhesives, magnets, a wedge and aperture connection, a screw, a bolt, a hinge, a staple, a nut, studs, snaps, wedges and a combination thereof or by other means known to one skilled in the art. In the embodiment having a plate below the cushioning, the plate preferably extends substantially at least along the length of the cushioning, but may also be tapered upwardly if the foam padding is also tapered or the toe area. See e.g., FIGS. 6–10, and 12–14. Additionally, in some cases, the plate is the wear surface of the footwear. See FIG. 9.

Figure 9:
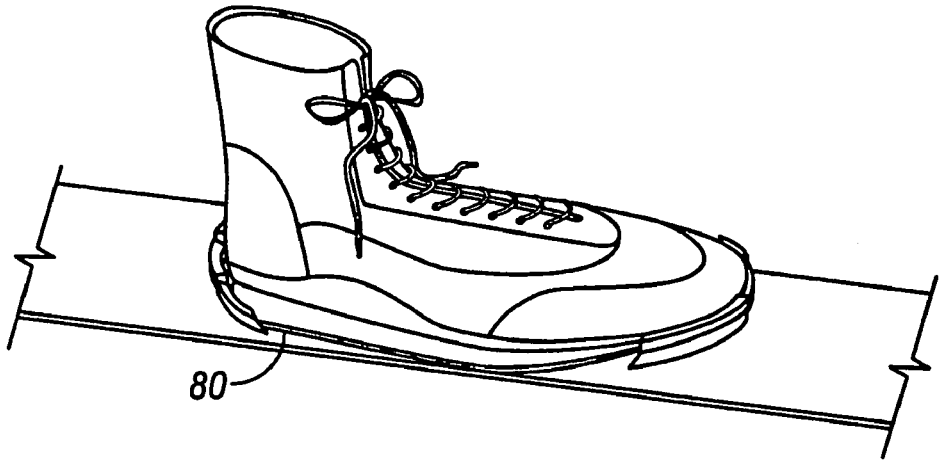
FIG. 9 is an embodiment of a ski boot.
Figure 10:
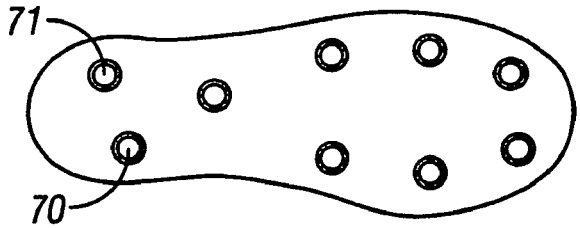
FIG. 10 is the bottom view of an embodiment of the footwear.
Figure 11A:
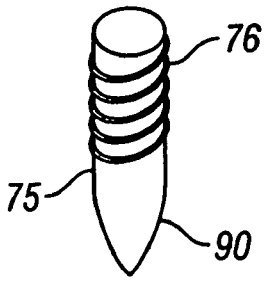
FIGS. 11 a–c are a side view of an embodiment of the gripping members of an embodiment of the footwear.
Figure 11B:
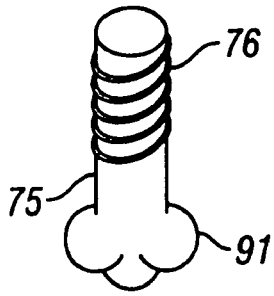
Figure 11C:
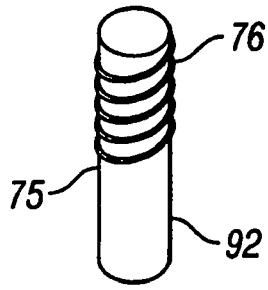

Again, the bottom plate 80 may also have gripping members 75 such as spikes, cleats, studs or other such gripping members which are permanent or removably attachable to the bottom plate 80 that may be changed for different uses such as golf, soccer, rugby, football and other sports or activities where such footwear is helpful or useful, or removed altogether for other activities where gripping members are unnecessary or unwanted. See FIGS. 6–8, 10, and 12–14. The gripping members 75 are preferably removably attached to the bottom plate 80 shoe by inserting a threaded end 76 of the gripping member 75 into an aperture 70 in the bottom plate that has corresponding threading 71 and then turning or screwing in the gripping member 75 until it is inserted. See FIGS. 8, 10. Alternatively, the gripping members 75 may be snapped into the apertures and then removed such as by a tool. (not shown) The gripping members may comprise a variety of shapes such as a spike end 90, see FIG. 11*a*, multi-lobed end 91, see FIG. 11*b*, a rounded end 92, see FIG. 11*c*, or other shapes known or used by one skilled in the art. Also see e.g. FIGS. 12–14. FIGS. 7 and 9 show embodiments of footwear that have a high top 100, and FIG. 9 has a two-plate system, but no gripping members, although the bottom plate may have a textured surface (not shown). Of course footwear with gripping members may have a high top.

In this invented footwear, the wearer will experience increased comfort and reduced stress when wearing footwear with gripping members, especially when the footwear is worn for several hours and/or when the wearer is involved in rigorous activities and/or when the ground surface is hard. In fact, the gripping members may be hardly noticeable to the wearer, unlike those in conventional footwear.

This invention also contemplates a method of making footwear comprising: providing an upper, obtaining an orthotic plate having a first surface and a second surface, wherein the first surface is removably or securably attachable to the upper, and adding at least one layer of cushioning having a top side and a bottom side, wherein the top side is removably or securably attachable to the second surface of the orthotic plate.

This method may also further comprise the step of attaching an orthotic plate to the upper, and attaching the cushioning to the orthotic plate. Additionally, in this method, a bottom plate may be obtained, wherein the plate has an upper side and a lower side, wherein the upper side is removably or securably attachable to the bottom side of the cushioning, and the plate is attached to the cushioning. Also, this method may further comprise the steps of providing at least one aperture in the bottom plate, and inserting a gripping member into at least one aperture. Also, this method may further comprise the step of removing the gripping member from the aperture.

The method may also further comprise separating at least the removably attachable padding and/or orthotic plate from the upper, and replacing the removed padding and/or orthotic plate with other removably attachable padding and/or another orthotic plate.

Additionally, the method may also comprise the steps of separating at least the upper from the orthotic plate, exchanging the separated upper with another upper, and attaching another upper to the orthotic plate.

The above description is that of preferred embodiments of the invention. Various alterations and changes can be made without departing from the spirit and broader aspects of the invention as defined in the appended claims, which are to be interpreted in accordance with the principles of patent law including the doctrine of equivalents.

What is claimed is:

1. Footwear comprising:

an upper having a bottom surface;

an orthotic plate with a first surface and a second surface, wherein said first surface is removably attachable to said bottom surface of said upper;

padding having a top side and a bottom side, wherein said top side is removably attachable to said second surface of said orthotic plate, wherein said padding is about ½ inch to 3½ inches in height;

a bottom plate having a upper side and a lower side, wherein said upper side is removably attachable to said bottom side of said padding, where said padding forms a layer from a front of said footwear to a rear of said footwear so as to isolate said orthotic plate from said bottom plate, thereby preventing contact between said orthotic plate and said bottom plate; and wherein said bottom plate comprises a smaller maximum height than a maximum height of said orthotic plate and/or a maximum height of said padding.

2. The footwear of claim 1, having padding selected from the group consisting essentially of silicon; neoprene; rubber; sponge; polyurethane; polyether; polyester; vinyl nitrile; ethyl vinyl acetate (EVA); ethylene propylene terpolymer (EPT); EPT/PE/Butyl Rubber; Neoprene/EPT/SBR; epichlorohydrin (ECH); and nitrile (NBR); or a combination thereof.

3. The footwear of claim 2, wherein said padding comprises foam, said padding having a smaller height at said front of said footwear as compared to a larger height at said rear of said footwear, at a cross-section taken parallel to a line from a front of said footwear to a rear of said footwear.

4. The footwear of claim 3, having at least one layer of open cell foam padding and at least one layer of closed cell foam padding.

5. The footwear of claim 3, wherein said orthotic plate is a rigid or semi-rigid piece extending at least from a metatarsal area of a wearer's foot to a rear area of the foot, the orthotic plate extending at least approximately two-thirds of a total horizontal length of the foot as measured from a toe area of the foot to the rear area of the foot.

6. The footwear of claim 1, said padding comprising a substantially wedge-shaped cross-section for a front-to-back cross-section taken parallel to said line from said front to said rear of said footwear.

7. The footwear of claim 1, having at least one layer of open cell foam padding.

8. The footwear of claim 1, having at least one layer of closed cell foam padding.

9. The footwear of claim 1, having an orthotic plate which is a unitary piece and wherein said second surface of said orthotic plate is substantially flat or at least partially rounded.

10. The footwear of claim 1, wherein said padding is removably and/or replaceably attached to said orthotic by hook and/or loop type fasteners, and wherein said hook and loop type fasteners are secured to the top side of said padding and the second surface of the orthotic, said fasteners being positioned so as to connect with counterpart hook and/or loop fasteners on the padding and the orthotic.

11. The footwear of claim 1, wherein said padding is removably and/or replaceably attached to the upper side of said bottom plate by hook and loop type fasteners, and wherein said hook and loop type fasteners are secured to the bottom side of said padding and the upper side of said bottom plate, said fasteners being positioned so as to connect to counterpart hook and/or loop fasteners on the padding and the bottom plate.

12. The footwear of claim 11, further comprising a plurality of gripping members extending from the lower side of the bottom plate.

13. The footwear of claim 12, wherein said bottom plate has a plurality of apertures for receiving said gripping members and wherein said gripping members are removably attachable to said bottom plate, said gripping members comprising threaded studs, said bottom plate comprising threaded holes for receiving said threaded studs, said treaded studs having a length such that said studs do not engage said orthotic plate.

14. Footwear comprising:

an upper having a bottom surface;

an orthotic plate with a first surface and a second surface, wherein said first surface is removably attached to said bottom surface of said upper;

padding having a top side and a bottom side, wherein said top side of the padding is removably attached to said second surface of said orthotic plate, and wherein said padding is about ½ inch to 3½ inches in height;

a bottom plate having a upper side and a lower side, wherein said upper side is removably attached to said bottom side of said padding, said bottom plate comprising a smaller maximum height than a maximum height of said orthotic plate and/or a maximum height of said padding;

said padding forming a layer from a front of said footwear to a rear of said footwear so as to isolate and prevent interconnection between said orthotic plate and said bottom plate; and a plurality of gripping members extending from the lower side of the bottom plate, said padding forming a layer so as to isolate and prevent interconnection between said orthotic plate and said gripping members.

15. The footwear of claim 14, wherein hook and loop type fasteners are secured to the first surface of the orthotic plate and the bottom surface of the upper, wherein said upper is capable of being attached to said orthotic plate by connecting said hook and loop type fasteners and/or detached from said orthotic plate by separating said hook and loop type fasteners.

16. The footwear of claim 15, wherein said upper side of said bottom plate is removably attachable to said padding.

17. The footwear of claim 15, wherein said orthotic plate is a rigid or semi-rigid piece extending at least from a metatarsal area of a wearer's foot to a rear area of the foot, said orthotic plate extending at least approximately two-thirds of a total horizontal length of the foot as measured from a toe area of the foot to the rear area of the foot.

18. The footwear of claim 15, wherein said padding is selected from the group consisting essentially of silicon; neoprene; rubber; sponge; polyurethane; polyether; polyester; vinyl nitrile; ethyl vinyl acetate (EVA); ethylene propylene terpolymer (EPT); EPT/PE/Butyl Rubber; Neoprene/EPT/SBR; epichlorohydrin (ECH); and nitrile (NBR); or a combination thereof.

19. The footwear of claim 18, wherein said padding comprises foam about ½ inch to about 2½ inches in height.

20. The footwear of claim 19, having open cell and/or closed cell foam padding.

21. The footwear of claim 18, wherein said padding comprises at least one layer of open cell foam and at least one layer of closed cell foam.

22. The footwear of claim 15, wherein the upper side of the bottom plate is removably attached to the bottom side of the padding by hook and/or loop fasteners, wherein said fasteners are securably attached said bottom plate and padding.

23. The footwear of claim 15, wherein said upper is attached or reattached to said orthotic plate by connecting said hook and loop type fasteners to counterpart hook and loop type fasteners after said upper and said orthotic plate are aligned.

24. The footwear of claim 15, having hook and/or loop type fasteners attached to said second surface of said orthotic plate and counterpart hook and/or loop type fasteners attached to the top side of said padding, such that said padding is capable of being detached from said orthotic and is capable of being reattached to said orthotic by connecting said counterpart fasteners.

25. The footwear of claim 24, wherein said padding is attached to said footwear by pressing said fasteners upon said padding into said fasteners on the second surface of said orthotic plate, thereby connecting said fasteners to each other and thereby attaching said padding to said footwear.

26. The footwear of claim 14, having hook and/or loop fasteners on the upper side of said bottom plate and counterpart hook and/or loop fasteners on the bottom side of said padding, said fasteners being positioned so that said bottom plate can be detached from and/or reattached to said padding with said fasteners.

27. The footwear of claim 14, wherein said bottom plate has a plurality of apertures for receiving gripping members, and wherein said gripping members are removably attachable to said bottom plate.

28. The footwear of claim 14, wherein said gripping members are integral with said bottom plate.

29. The footwear of claim 14, further comprising a plurality of gripping members extending from the bottom plate, wherein said bottom plate has a plurality of apertures for receiving gripping members, and wherein said gripping members are removably attachable to said bottom plate, said gripping members comprising threaded studs, said bottom plate comprising threaded holes for receiving threaded studs, said threaded studs having a length such that said studs do not engage said orthotic plate.

30. The footwear of claim 14, wherein said bottom plate has a plurality of gripping members and wherein said gripping members are integral with said bottom plate.

31. Footwear comprising:

an upper having a bottom surface;

a rigid orthotic plate with a first surface and a second surface, wherein said first surface is removably attachable to said bottom surface of said upper, said rigid orthotic plate being a rigid piece extending at least from a metatarsal area of a wearer's foot to a rear area of the foot, said orthotic plate extending at least approximately two-thirds of a total horizontal length of the foot as measured from a toe area of the foot to the rear area of the foot;

padding having a top side and a bottom side, wherein said top side is removably attachable to said second surface of said orthotic plate, and wherein said padding is about ½ inch to 3½ inches in height; and a rigid second plate having an upper side and a lower side, wherein said upper side is removably attachable to said bottom side of said padding, where said padding forms a shock absorbing layer from a front of said footwear to a rear of said footwear so as to isolate said orthotic plate from said rigid second plate, thereby preventing contact between said rigid orthotic plate and said rigid second plate for absorbing shock applied to said rigid orthotic plate.

32. The footwear of claim 31, comprising padding constructed of foam with a density of about 0.08 $g/cm^3$ to 0.40 $g/cm^3$.

* * * * *

UNITED STATES PATENT AND TRADEMARK OFFICE

CERTIFICATE OF CORRECTION

PATENT NO. : 7,111,416 B2
APPLICATION NO. : 10/409751
DATED : September 26, 2006
INVENTOR(S) : Alvaro Z. Gallegos It is certified that error appears in the above-identified patent and that said Letters Patent is hereby corrected as shown below:

On the title page item (54), and col. 1, line 1, correct the title to read:
FOOTWEAR WITH TWO-PLATE SYSTEM On the title page item (57), line 7, of the Abstract, delete "may".

Signed and Sealed this

Twenty-sixth Day of December, 2006

JON W. DUDAS
*Director of the United States Patent and Trademark Office*